United States Patent [19]

Bartels

[11] Patent Number: 4,513,910

[45] Date of Patent: Apr. 30, 1985

[54] ADAPTIVE LOW FIRE HOLD CONTROL SYSTEM

[75] Inventor: James I. Bartels, Hudson, Wis.

[73] Assignee: Honeywell Inc., Minneapolis, Minn.

[21] Appl. No.: 651,490

[22] Filed: Sep. 17, 1984

[51] Int. Cl.[3] ..... F22B 35/00; G05D 15/00

[52] U.S. Cl. ..... 236/26 R; 122/448 R; 236/1 EB; 236/78 D

[58] Field of Search ..... 122/448 R; 237/8 R, 237/65; 236/78 D, 26 A, 26 E, 26 R, 1 EB

[56] References Cited

U.S. PATENT DOCUMENTS 3,486,693 12/1969 Stang, Jr. et al. ..... 236/78 D X 4,003,342 1/1977 Hodgson ..... 122/448 R

*Primary Examiner*—William E. Wayner

*Attorney, Agent, or Firm*—Alfred N. Feldman

[57] ABSTRACT

A boiler control utilizing a pressure sensor is provided that operates the system in the low fire mode if the load is light, and can be satisfied in that mode. If the low fire operation is inadequate to hold the load and the pressure drops, the boiler is then operated in a modulating mode which includes a high fire limit. This is accomplished by sensing the variation of a pressure responsive means and by providing a burner control system that monitors that pressure responsive means.

9 Claims, 4 Drawing Figures

ADAPTIVE LOW FIRE HOLD CONTROL SYSTEM

CROSS-REFERENCE TO RELATED APPLICATION

The present application is being filed on even date with an application entitled Fuel Burner Control System With Low Fire Hold, Ser. No. 651,489, by the same inventor and assigned to the assignee of the present application.

BACKGROUND OF THE INVENTION

The transfer of energy to and from a working fluid typically is accomplished under the control of a condition sensing device such as a temperature responsive unit or a pressure responsive unit. Ordinarily, the condition responsive means measures a single condition of the working fluid and in turn controls the rate of transfer of energy to or from the working fluid in proportion to the deviation from a set point. This type of control system typically has a proportional offset which is an offset from the desired setpoint or control point established for the operation of the system.

In many systems, there is a minimum or fixed lowest possible energy transfer rate for the system. Above that minimum rate, the system typically can modulate continuously to some fixed upper limit. There are startup energy losses associated with the transition between a complete off state and the lowest operating rate, and therefore each time the system is caused to cycle there is a significant startup loss.

The startup losses, and the operation of the system with a proportional offset, typically leads to certain inefficiencies. A more efficient manner of operating such a system can be brought about by minimizing the number of startup times for the system, and by tailoring the operation of the control so that the working fluid is not over heated to supply just the minimum amount of energy required to satisfy a particular load.

A description of a prior art type of condition control system will be described in the section of the application entitled "Description of the Preferred Embodiment" with reference to FIG. 1 which is identified as prior art. This description will establish what some of the prior art is, and will show why that type of prior art control system is deficient as relates to an efficient manner of operating a condition control system. The system that will be described will specifically be a boiler supplying steam to a steam heated load in response to a fuel burner control system. A further prior art system which provides an economical and efficient manner of operating is also disclosed in U.S. Pat. No. 4,373,663 issued Feb. 15, 1983, to J. M. Hammer.

The present description will be directed primarily to boilers in which water is converted to steam and then applied as the working fluid to a load. Under these conditions, a pressure sensor determines the condition of the working fluid and this type of system operates with a fuel burner that is initially operated to a low fire rate, and then released to a high fire rate. Typically this type of system operates in a modulating manner between the two fixed rates in order to satisfy the demand for steam from the boiler. The pressure sensor regulates the burner. This type of system is inefficient in that each time the burner starts, losses accompany the startup, and further the system is inefficient in that the pressure sensor normally provides a much higher pressure than is necessary to efficiently satisfy the load.

SUMMARY OF THE INVENTION

A boiler operating scheme somewhat similar to that disclosed in the Hammer U.S. Pat. No. 4,373,663 can be implemented in a highly simplified form by the use of an existing pressure operated modulating control and an impedance detection circuit. A boiler installation normally has a pressure responsive control mounted thereon. This pressure responsive control can be used with a modified burner control system. A boiler operating system can be developed which provides for the adjustment of the burner output or fire size to match the load demand on the boiler. The boiler firing rate is a function of boiler pressure, and with this highly simplified arrangement a more efficient boiler operating arrangement can be provided wherein a low fire operation of a boiler can be tested to determine whether the low fire operation is capable of satisfying the existing demand. If the low fire operation is capable of satisfying the existing demand, the boiler operating cycle is extended and energy is saved due to the reduction in number of cycles needed and their relatively long operating time. If the boiler demand cannot be met at the low fire operating point, the system automatically switches to a normal high fire and modulating mode to provide a response to the higher load level. Each time the burner is initiated for the system, a check is automatically made to determine if the low fire setting is capable of supplying the demand.

The present invention can be accomplished by a single potentiometer arrangement that is responsive to boiler pressure. This type of a device is currently installed in boiler systems, and is of the type sold by Honeywell Inc. and identified as an L91 Modulating Pressuretrol. In the present invention, an impedance detection circuit means is adapted to work with, or is incorporated within, a Microcomputer Burner Control System of the type sold by Honeywell Inc. and identified as a BC7000. The Microcomputer Burner Control System is a microcomputer based program burner control device that responds to various limits, safeties, and a pressure control to sequence a burner and damper motor. The addition of the present invention to this type of an installation allows for an impedance detection circuit means to be added which is capable of holding the burner in a low fire mode if that mode will satisfy the load. If the load cannot be satisfied, the system is released to the high fire and modulating mode of operation conventionally employed with this type of a system. Since the present invention can be adapted to existing equipment with a minimum amount of modification, it is apparent that a practical and inexpensive energy saving configuration is available.

In accordance with the present invention, there is provided a control system adapted to control modulating motor means and a fuel burner with said burner having a low fire mode, and a modulating mode including a high fire limit of operation to heat a boiler to provide a fluid pressure, including: pressure responsive means responsive to said fluid pressure in said boiler; said pressure responsive means having variable impedance means being varied in response to said pressure; fuel burner sequencer means including program means to implement a control sequence for said modulating motor and said fuel burner in response to said variable impedance means; said program means having output means to control said modulating motor means and said fuel burner; impedance detection circuit means having input means and having an output connected to said fuel burner sequencer means; said impedance detection circuit input means being responsive to said variable impedance means with said impedance detection circuit means causing said fuel burner sequencer means to hold said fuel burner in said low fire mode upon a startup of said burner with said impedance detection circuit means detecting said impedance means in an impedance range indicating said fluid pressure is steady or rising; and said impedance detection circuit means causing said fuel burner sequencer means to release said fuel burner to said high fire limit and modulating mode upon a fall in said fluid pressure.

DESCRIPTION OF THE PREFERRED EMBODIMENT

Figure 1:
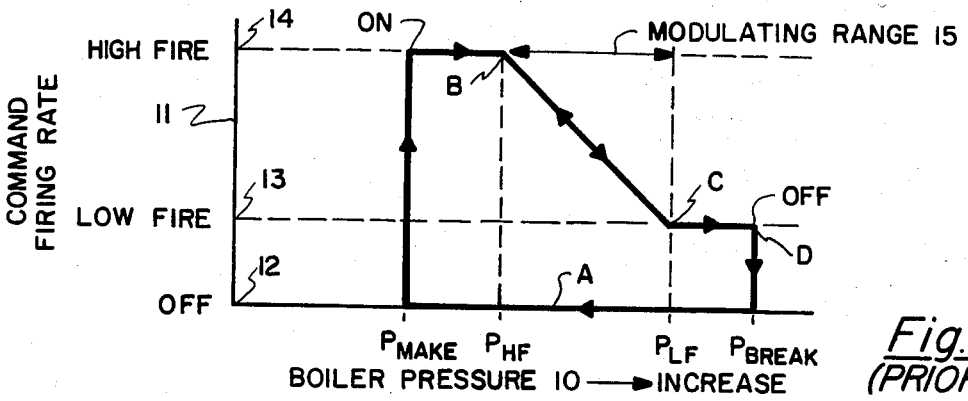
Fig. 1 (PRIOR ART)
FIG. 1 is a prior art conventional proportional system that includes an on/off control.

In FIG. 1 a typical operating cycle for a boiler is disclosed. The boiler pressure 10 is plotted versus the firing rate 11. The boiler pressure 10 increases from left to right and the firing rate is indicated as either being "off" at 12, being at low fire 13, or being at high fire 14. A modulating range between the high fire 14 and the low fire 13 is disclosed at 15.

Assume the boiler has just shut down at pressure $P_{break}$. If there is a load on the boiler, the pressure will decrease along line A. When the pressure reaches $P_{make}$, the burner is started with the highest possible firing rate 14. The pressure will increase to a point B. At this pressure, the control begins to throttle back the burner firing rate. The control will then modulate the burner between point B at the high fire 14, and a point C to match the boiler load. If, however, the load is light, the pressure will continue to rise even at the lowest firing rate along line C to a point D. At point D the pressure is sufficiently high to cause the burner to shut down and the cycle is complete. This method of control provides very stable operation with a load that falls within the modulation range 15. This type of operation is undesirable for light loads because the firing of the burner above the lowest possible firing rate to meet the load requirements is inefficient and will cause rapid cycling of the burner system. This increases the wear on the mechanical parts, and also is inefficient in that the start up of a burner of large size normally entails prepurge and postpurge functions which vent combustion products to the atmosphere without being able to utilize any of the heat content in those combustion products.

Figure 2:
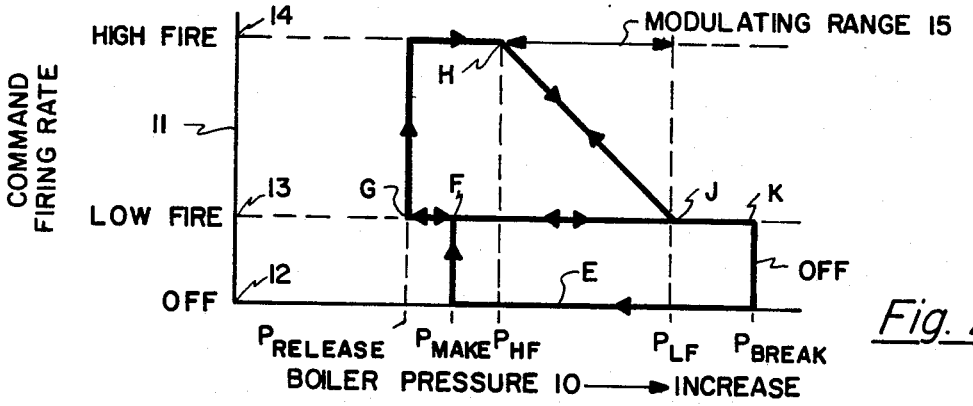
FIG. 2 is a representation of a proportional control system incorporating the present invention.

An improved method of pressure control is shown in FIG. 2. Again the boiler pressure 10 is plotted as increasing from left to right, and the "off" point 12, the low fire point 13, and the high fire point 14 are disclosed for the firing rate 11 of the boiler. A modulation range 15 is again provided. In this case assume that the boiler is "off" and that the pressure is falling along a line E. When the pressure falls to $P_{make}$, the boiler is brought on at the lowest possible firing rate 13 as indicated at point F. If the load is sufficiently large, the pressure will continue to fall from the point F to a point G. At this pressure the control recognizes the load requires a higher firing rate, and releases the system to the high fire 14, and subsequently to the modulation range 15. Modulation will result along the line H to J as in the example in FIG. 1.

If the load is small, however, the pressure will not fall from point F to point G. With a light load, the pressure will rise along the line F to a point J, while the burner for the boiler is held at a low fire position. The pressure will finally rise to the pressure $P_{break}$, and the burner will be shut down completing the cycle. The time required to complete this cycle is significantly longer compared to a typical control cycle because the pressure rises more slowly at a low fire rate 13 compared to a high fire rate 14. The desirable stability of the original control is still retained in the modulation mode. A further advantage of this arrangement is the ease with which it can be implemented. A control circuit capable of implementing this arrangement utilizing commercially available components is shown in the circuit of FIG. 3.

Figure 3:
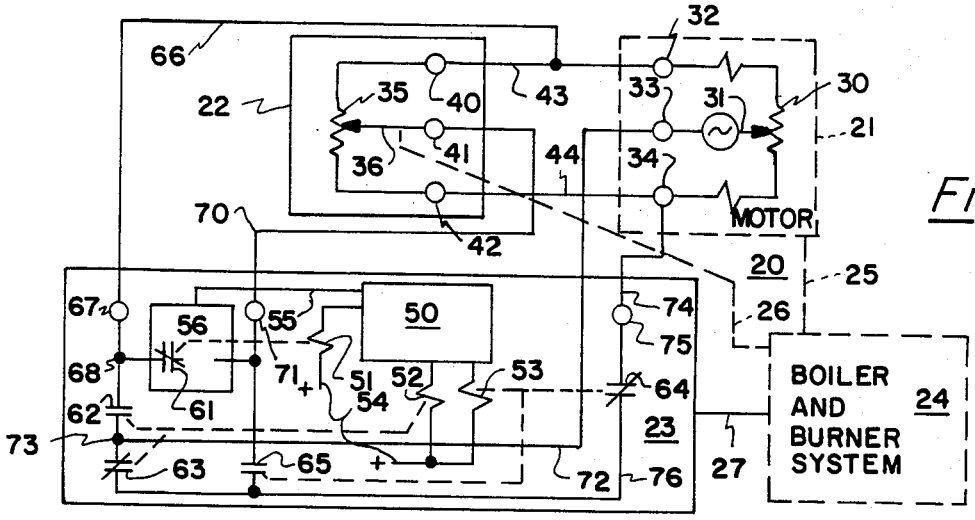
FIG. 3 is a schematic circuit of the entire control system.

In FIG. 3 a control system for a burner is disclosed at 20. The control system 20 includes a conventional modulating motor 21, a pressure responsive potentiometer 22 (of the type referred to as an L91 Pressuretrol), and a fuel burner sequencer means 23 of the type referred to as the BC7000 Microcomputer Burner Control System. The control system 20 operates a boiler and burner system 24. The modulating motor 21 is connected at 25 to the boiler and burner system 24 to operate the fuel valve and draft control for the burner within the system. The pressure in the boiler is communicated at 26 to the potentiometer 22. The boiler and burner system 24 is basically controlled via an electrical connection 27 from the fuel burner sequencer means 23. The other interconnection means will be described in connection with a description of the circuitry.

The modulating motor 21 is of a conventional and commercially available design having a potentiometer 30 and including a wiper 31 that is connected to three terminals 32, 33, and 34. The motor 21 is of a rebalancing type and the potentiometer provides a feedback to the system via the terminals 32, 33, and 34 to indicate the position of the motor in its operation.

The pressure responsive means 22 has the potentiometer 35 and includes a wiper 36. The potentiometer 35 includes the terminals 40, 41, and 42. As previously indicated, the pressure responsive means 22 is, or can be, a conventional potentiometer and normally would have a 0 to 135 ohm value to be compatible with conventional burner control systems. It will be noted that the terminals 40 and 32 of the potentiometers 30 and 35 are directly connected together at 43, while the terminals 34 and 42 are connected at 44.

Included within the fuel burner sequencer means 23 is a microprocessor based program means 50 that is used to control the energization of and the programming of, the fuel burner sequencer means 23. Only three relays will be specifically disclosed as driven from the program means 50. These relays are relays 51, 52, and 53. The relay 51 has a normally closed contact 61, while the relay 52 has a normally open relay contact 62 and a normally closed relay contact 63. The relay 53 has two contacts. These contacts are a normally closed contact 64 and a normally open contact 65. These relays are energized by an internal source of potential indicated at 54. Only one of many input circuits has been disclosed for the program means 50, and that is at a conductor 55. The conductor 55 connects the program means 50 to a pulse generating and pulse detecting means disclosed generally at 56. The circuit details of the pulse generating and pulse detecting means 56 are shown in detail in FIG. 4, and will be described in connection with that Figure.

The circuit of FIG. 3 is completed by a number of interconnecting leads. A lead 66 connects the conductor 43 to a terminal 67 that in turn is connected at 68 to one side of the contact 62 and to one side of the contact 61. A conductor 70 is provided from a terminal 71 of the fuel burner sequencer means 23 to the terminal 41 which in turn is connected to the wiper 36 of the pressure responsive means or potentiometer 22. A conductor 72 connects the terminal 33 of the motor 21 to a node 73 between the relay contact 62 and 63. A further conductor 74 is provided between the terminal 34 of the motor 21 and a terminal 75 that is connected to the normally closed contact 64 of the relay 53. The other side of the normally closed contact 64 is connected by conductor 76 to the relay contacts 63 and 65.

Figure 4:
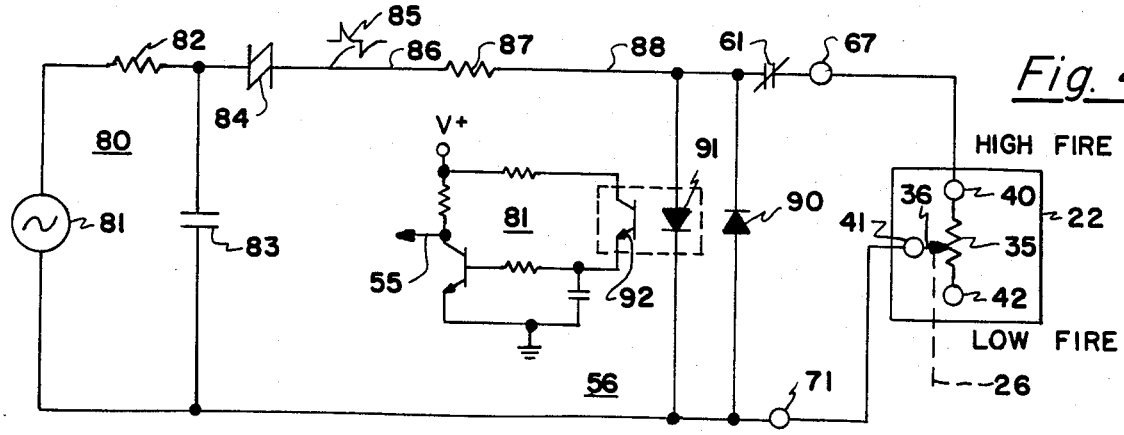
FIG. 4 is a schematic circuit of a pulse generating and pulse detection circuit used in FIG. 3.

The operation of FIG. 3 will be discussed after FIG. 4 has been described, as the functioning within FIG. 4 aids in an understanding of the operation of FIG. 3. The impedance detection circuit means 56 of FIG. 4 is made up of two portions. The left most portion 80 provides a pulse generating means while the portion at 81 provides a pulse detection means. The pulse generating portion 80 includes a source of potential 81 of an alternating current type. The energy is supplied through a resistor 82 and a capacitor 83 to a solid state switching element 84 which breaks down and conducts, and then ceases to conduct, providing a set of pulses as indicated at 85 at conductor 86. The pulses on conductor 86 are provided through a current limiting resistor 87 to an output conductor 88. The pulses are conducted alternately through a diode 90 and a light emitting diode 91. Each time the light emitting diode 91 conducts, a light responsive transistor 92 is changed in conduction and an output pulse is provided on the conductor 55, which will be noted as being disclosed as connected to the program means 50 of FIG. 3. The pulse generating and pulse detection means 56 is connected through the normally closed relay contact 61 to the terminal 67. Disclosed again is the pressure responsive means 22 including the potentiometer 35 and the associated wiper 36 along with the terminal 41 connected to terminal 71. The wiper 36 is pressure driven at 26.

It will be noted that the portion of the potentiometer 35 between the wiper 36 and a terminal 40 is effectively connected across the diode 90. If the resistance portion becomes quite small, the pulses generated in the pulse generation section of the impedance detection circuit means 56 are effectively shorted out. This causes the output of pulses on the conductor 55 to cease. As such, when the resistance between the wiper 36 and the terminal 40 is small, no pulses are provided on the conductor 55. When the resistance between the terminals 40 and 41 is relatively large, pulses are provided on the conductor 55 indicating that the terminals 67 and 71 are not effectively shorted out. As such, the impedance detection circuit means utilizes a pulse generating and pulse detection means to, in effect, reflect the amount of resistance present at the pressure responsive means 22. In the modulating mode of operation, the resistance is sufficiently low to eliminate the pulsing from the impedance detection circuit means 56, and this indicates to the program means 50 that operation should be in the modulating mode. The modulating mode causes relay 51 to be energized and contact 61 is open circuited to remove the pressure responsive means 22 from the impedance detection circuit means 56.

If it is assumed that the burner system 24 has been deenergized and is just brought back into operation, the presence of sufficient pressure in the boiler causes the wiper 35 to move towards the terminal 42. The impedance detection circuit means 56 provides a series of pulses via the conductor 55 to the program means 50, and the control system for the boiler and burner 24 is held in the low fire mode as indicated at F in FIG. 2. If this low fire mode is insufficient to hold the pressure, the pressure drops to point G. At this point the resistance of the potentiometer 35 has decreased sufficiently so that the impedance detection circuit means 56 ceases supplying pulses on the conductor 55. This indicates to the program means 50 that the pressure is not being held and that the system is at point G in FIG. 2. At this time the program means 50 places the system in a normal modulating mode which includes opening contact 61, allowing the system to go to a high fire limit of operation, and then into the modulating mode to supply heat at a rate required by the boiler to supply the then existing load.

Each time the system is turned off and restarted, the system determines whether a low fire operation is capable of holding the load being called for by the pressure responsive means 22. If it is, the operation is extended for a period of time at the low fire mode thereby accomplishing an energy saving function not normally available with the prior art device of the type disclosed in FIG. 1.

The present invention can be implemented with many different types of fuel burner sequencer means, different types of program means, and various types of impedance detection circuits. Various types of pressure responsive means that have a varying output with the pressure in the boiler being fired by the burner of the system can be used. As such, the applicant wishes to be limited in the scope of his invention solely by the scope of the appended claims.

The embodiments of the invention in which an exclusive property or right is claimed are defined as follows:

1. A control system adapted to control modulating motor means and a fuel burner with said burner having a low fire mode, and a modulating mode including a high fire limit of operation to heat a boiler to provide a fluid pressure, including: pressure responsive means responsive to said fluid pressure in said boiler; said pressure responsive means having variable impedance means being varied in response to said pressure; fuel burner sequencer means including program means to implement a control sequence for said modulating motor and said fuel burner in response to said variable impedance means; said program means having output means to control said modulating motor means and said fuel burner; impedance detection circuit means having input means and having an output connected to said fuel burner sequencer means; said impedance detection circuit input means being responsive to said variable impedance means with said impedance detection circuit means causing said fuel burner sequencer means to hold said fuel burner in said low fire mode upon a startup of said burner with said impedance detection circuit means detecting said impedance means in an impedance range indicating said fluid pressure is steady or rising; and said impedance detection circuit means causing said fuel burner sequencer means to release said fuel burner to said high fire limit and modulating mode upon a fall in said fluid pressure.

2. A control system adapted to control modulating motor means and a fuel burner with said burner having a low fire mode, and a modulating mode including a high fire limit of operation to heat a boiler to provide a fluid pressure, including: pressure responsive means responsive to said fluid pressure in said boiler; said pressure responsive means having variable impedance means being varied in response to said pressure; fuel burner sequencer means including program means to implement a control sequence for said modulating motor and said fuel burner in response to said variable impedance means; said program means having output means to control said modulating motor means and said fuel burner; impedance detection circuit means connected to a source of potential and including pulse generating and pulse detection means; said impedance detection circuit means having an output connected to said fuel burner sequencer means; said impedance detection circuit means being responsive to said variable impedance means to vary a pulse rate of said pulse generating means to in turn cause said fuel burner sequencer means to hold said fuel burner in said low fire mode upon a startup of said burner with said impedance detection circuit means detecting said impedance means in an impedance range indicating said fluid pressure is steady or rising; and said impedance detection circuit means causing said fuel burner sequencer means to release said fuel burner to said high fire limit and modulating mode upon a fall in said fluid pressure.

3. A control system adapted to control modulating motor means and fuel burner means as claimed in claim 2 wherein said output means of said program means is a switched output means.

4. A control system adapted to control modulating motor means and fuel burner means as claimed in claim 3 wherein said pressure responsive variable impedance means is variable resistance means.

5. A control system adapted to control modulating motor means and fuel burner means as claimed in claim 4 wherein said variable resistance means is a potentiometer.

6. A control system adapted to control modulating motor means and fuel burner means as claimed in claim 5 wherein said impedance detection circuit means includes pulse generator means with said pulse generator means being connected to a source of alternating current and said alternating current being converted to a series of pulses; said impedance detection circuit means further including pulse detection circuit means with said pulse detection circuit means having an input and an output; said pulse detection circuit means input connected to said potentiometer; and said pulse detection circuit means output connected to said program means.

7. A control system adapted to control modulating motor means and fuel burner means as claimed in claim 6 wherein said program means switched output means includes electromagnetic relays with associated switched contacts.

8. A control system adapted to control modulating motor means and fuel burner means as claimed in claim 7 wherein said impedance detection circuit means has one of said switched contacts in a series circuit between said potentiometer and said pulse detector means; said series circuit being open circuited by said one of said switched contacts upon said fuel burner sequencer means operating said fuel burner in said modulating mode.

9. A control system adapted to control modulating motor means and fuel burner means as claimed in claim 8 wherein said electromagnetic relay switched contacts connect said impedance detection circuit means to said control system to implement said low fire and modulating modes of operation in response to said burner program means and said potentiometer.

* * * * *